US011192697B2

(12) United States Patent
Kouba

(10) Patent No.: US 11,192,697 B2
(45) Date of Patent: Dec. 7, 2021

(54) LOW PROFILE CONTAINER COVER AND ASSEMBLY

(71) Applicant: SCHOENECK CONTAINERS, INC., New Berlin, WI (US)

(72) Inventor: Joshua R. Kouba, Waukesha, WI (US)

(73) Assignee: SCHOENECK CONTAINERS, INC., New Berlin, WI (US)

( * ) Notice: Subject to any disclaimer, the term of this patent is extended or adjusted under 35 U.S.C. 154(b) by 0 days.

(21) Appl. No.: 16/988,255

(22) Filed: Aug. 7, 2020

(65) Prior Publication Data

US 2021/0039842 A1 Feb. 11, 2021

Related U.S. Application Data

(60) Provisional application No. 62/884,245, filed on Aug. 8, 2019.

(51) Int. Cl.
*B65D 43/02* (2006.01)
*B65D 47/08* (2006.01)

(52) U.S. Cl.
CPC ..... *B65D 43/021* (2013.01); *B65D 47/08* (2013.01); *B65D 2543/0049* (2013.01); *B65D 2543/00092* (2013.01)

(58) Field of Classification Search
CPC ..... B65D 43/021; B65D 47/08; B65D 2543/00092; B65D 2543/00435; B65D 43/162
USPC ..... 220/789
See application file for complete search history.

(56) References Cited

U.S. PATENT DOCUMENTS

2007/0138180 A1* 6/2007 Vovan ..... B65D 43/0235 220/266
2013/0206763 A1* 8/2013 Sinn ..... B65B 3/02 220/240
2015/0060477 A1* 3/2015 Barbaros ..... B65D 43/0208 220/780
2015/0366755 A1* 12/2015 Milante ..... B65D 43/0218 215/203
2018/0282054 A1* 10/2018 Frank ..... B65D 83/0835
2019/0177056 A1* 6/2019 Wang ..... B65D 43/162

* cited by examiner

*Primary Examiner* — Shawn M Braden
(74) *Attorney, Agent, or Firm* — Joseph S. Heino; Erin E. Kaprelian

(57) ABSTRACT

A container cover and assembly provide an extremely low profiled edge to the container cover when the container cover is secured or attached to a complementary container. Using such a low profile results in less of an edge being exposed such that its profile works to prevent inadvertent opening of the hinged lid from the container cover and also prevent removal of the container cover from the container. The container cover comprises two halves that are integrally-molded. The two halves are connected by a common pivot point or hinge that is disposed to one side of each half which allows the halves to be folded over and onto one another. The structure of the container cover and integrally-formed hinged lid can be formed using a one-shot plastic injection molding process. This simplifies and speeds up the production process for manufacturing the container cover and hinged lid combination.

2 Claims, 4 Drawing Sheets

LOW PROFILE CONTAINER COVER AND ASSEMBLY

This application claims the benefit and priority of U.S. Provisional Patent Application No. 62/884,245 filed Aug. 8, 2019.

FIELD OF THE INVENTION

The present invention relates generally to product packaging and to containers and container covers of the type used to retain a product within the container. More specifically, the present invention relates to a container cover structure that is configured as an extremely low profiled cover thereby making the cover extremely difficult to accidently or unintentionally remove or dislodge from the container it is secured to. Further, the present invention relates to a container cover having an integrally-formed and hinged lid, which is also low profiled. Further, the present invention relates to such a structure whereby that the container cover and its hinged lid can be integrally formed using one-shot plastic injection molding fabrication technology.

BACKGROUND OF THE INVENTION

Containers with covers are well known in the art. Covers are provided to allow or prevent access to the contents of the container as desired or required. Flip-top covers are also well known and have been integrated for use with many types of containers of the type that are used for the storage of food products, sanitary cleaning wipes, and any number of other uses. The containers can be cylindrical, oval or polyhedral in shape, but are typically configured with side walls and a floor. A cover typically attaches at the top opening of the container.

One such cover is disclosed in U.S. Pat. No. 10,576,271 to Frank et al. ("Frank"). In the preferred embodiment of Frank, a container is presented which relates to containers of the type that are dispensers for towelettes, which are also commonly called "wet wipes" when the towelettes are pre-moistened with a liquid of the type that is used for any number of personal, household, automotive or other purposes or applications. However, the container of Frank is not limited to that specific use, but its structure is related generally to that of the present invention.

In the experience of this inventor, there is a need for an improved low profile container cover and assembly, the assembly including a container to which the container cover is attached. The low profile of the container cover is intended to prevent accidental opening of an integrally-formed and hinged lid, or separation of the hinged lid from the container cover when the hinged lid and the container cover are in a "closed" position relative to one another. It is also desirable that the low profile container cover and hinged lid provide a structure that can be conveniently and integrally formed using a one-shot plastic injection molding process.

SUMMARY OF THE INVENTION

In accordance with the foregoing, the container cover and the assembly of the present invention each provide an extremely low profiled edge to the container cover when the container cover is secured or attached to a complementary container. Using such a low profile results in less of an edge being exposed such that its profile works to prevent inadvertent opening of the hinged lid from the container cover and also prevent removal of the container cover from the container. The structure of the container cover and integrally-formed hinged lid of the present invention can be formed using a one-shot plastic injection molding process. This fabrication method is desirable because it simplifies and speeds up the production process for manufacturing the container cover and hinged lid combination.

Generally speaking, the container cover of the present invention comprises two halves that are integrally-molded. The two halves are connected by a common pivot point or hinge that is disposed to one side of each half which allows the halves to be folded over and onto one another. The hinged lid is configured to fit with and engage the container cover via the common hinge or pivot point.

The foregoing and other features of the low profile container cover and assembly of the present invention will be will be apparent from the detailed description that follows.

DETAILED DESCRIPTION OF THE INVENTION

Figure 1:
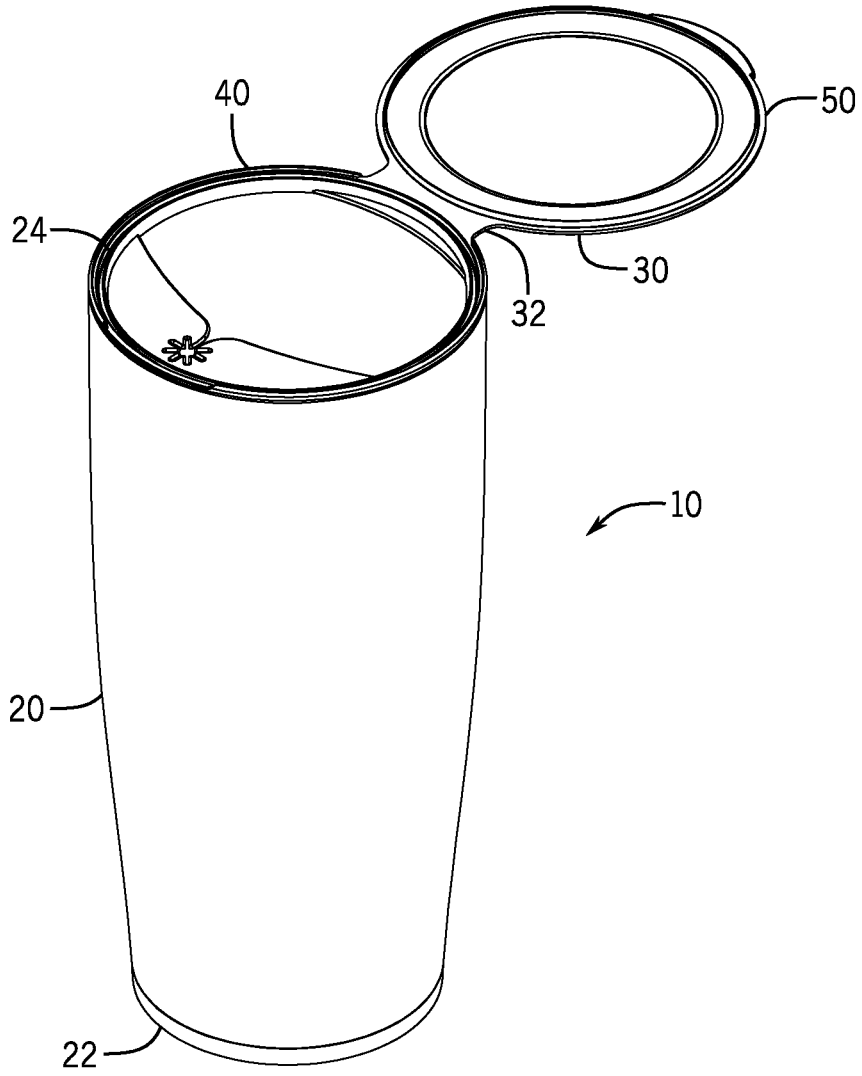
FIG. 1 is a top and side perspective view of the container and the low profile container cover assembly as described herein and showing the lid thereof in the "open" position.
Figure 2:
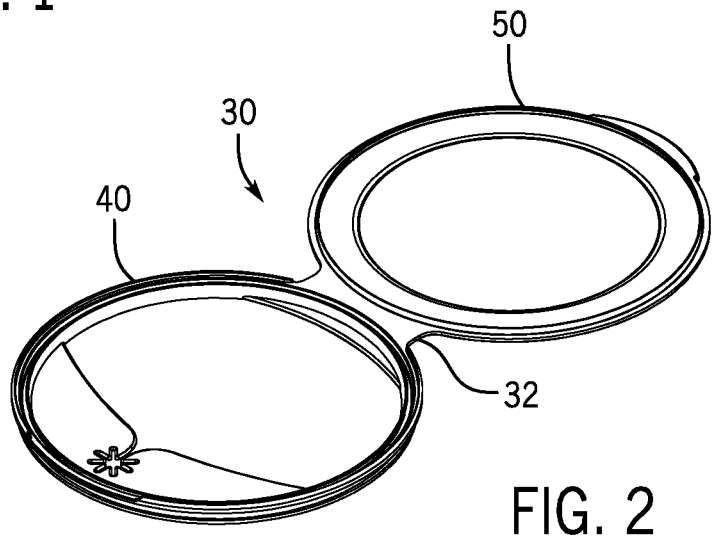
FIG. 2 is the same view as that shown in FIG. 1 but showing only the cover element thereof, also with its lid shown in the "open" position.
Figure 3:
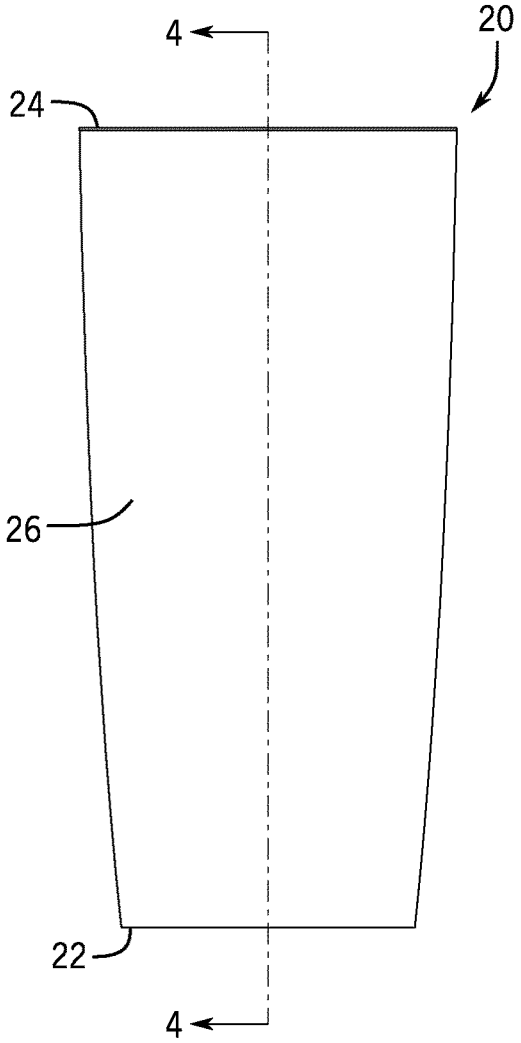
FIG. 3 is a side elevation view of the container shown in FIG. 1.
Figure 4:
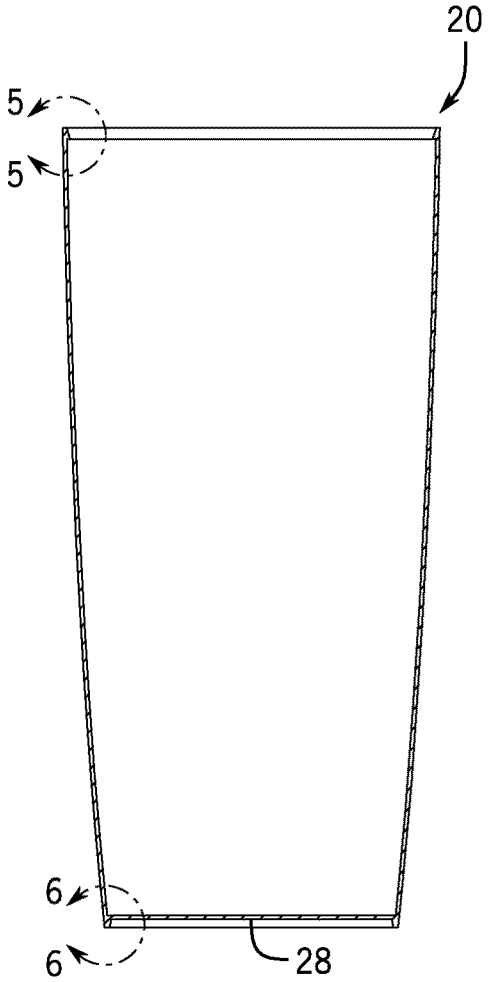
FIG. 4 is a side elevational and cross-sectioned view of the container shown in FIG. 1 and taken along line 4-4 of FIG. 3.
Figure 5:
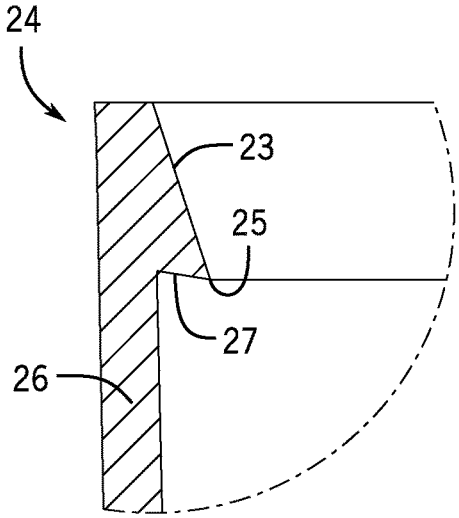
FIG. 5 is a greatly enlarged cross-sectioned view detailing the sealing point interface at the top of the cover taken along circular line 5 of FIG. 4.
Figure 6:
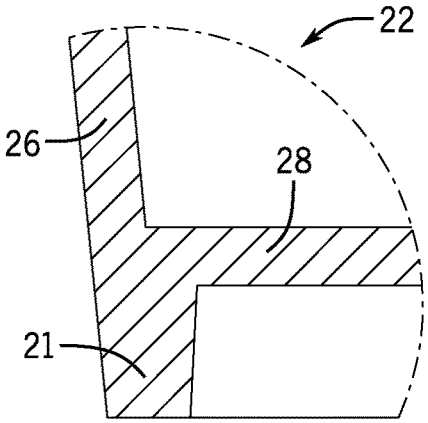
FIG. 6 is a greatly enlarged cross-sectioned view detailing the base of the container taken along circular line 6 of FIG. 4.

Referring now to the drawings in detail, wherein like-numbered elements refer to like elements throughout, FIGS. 1 and 2 illustrate the structure of the container and cover assembly, generally identified 10, and the integral cover and lid subassembly, generally identified 30, respectively. Both FIGS. 1 and 2 show the lid 50 of the cover and lid subassembly 30 in an "open" position. The cover and lid subassembly 30 comprise three essential structural elements. One is the container cover base 40; the container cover lid 50; and the flexible hinge 32. In production, the container and cover assembly 10 is preferably a piece of plastic formed by injection molding. The plastic type and durometer are not limited, but the plastic should be of a type that has some inherent "memory" to it, i.e. where the plastic members can be flexed but then return to an original position. Further, and although illustrated to be cylindrical in shape, the container cover base 40 and the container cover lid 50 could be alternatively configured. Lastly, FIGS. 1 and 2 illustrate that the container 20 comprises a circumferential bottom edge 22 and a circumferential top edge 24.

Referring now to FIGS. 3 through 6, they show several cross-sectioned views of the container 20. Extending between the bottom edge 22 and top edge 24 of the container 20 is a container wall 26. The container 20 also comprises a floor 28. In the container 20 that is constructed in accordance with the present invention, the bottom edge 22 comprises a circumferential leg 21 that supports the container 20 in an upright position. See FIG. 6. However, the container 20 may also be configured without a circumferential leg 21 such that the floor 28 of the container 20 is simply a flat surface that can sit on another flat surface.

The construction of the top edge 24 of the of the container 20 is more complex by design. Specifically, the top edge 24 comprises a circumferential inner wall portion 23 that is biased inwardly moving from the top of the container 20 and downwardly. That is, this inner wall portion 23 is tapered inwardly to the point that it terminates in a circumferential catch 25. See FIG. 5. Extending outwardly from the catch 25 is a circumferential recess 27 that is biased upwardly moving from the catch 25 to the inner surface of the side wall 26. This structure is provided to provide complementary structure that allows for engagement of the container cover 30 to the container 20. In this particular embodiment, an inwardly-extending and generally horizontal pull-through structure 48 is disposed to that side of the container cover base 40, positioned 180° opposite the flexible hinge 32. The pull-through structure 48 includes a star-shaped feed-tear notch 49 of the type that would be used to dispense, for example, wet wipes, although it must be emphasized that the present invention is not so limited to that usage. The low profile container cover 30 and assembly 10 of the present invention can just as easily be configured without the surface 48 and notch 49 described above.

Figure 7:
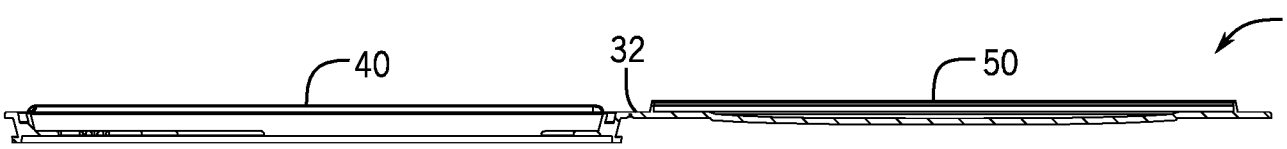
FIG. 7 is a side elevational and cross-sectioned view of the cover and lid, taken along line 7-7 of FIG. 8 and with the lid being shown in the "open" position.
Figure 8:
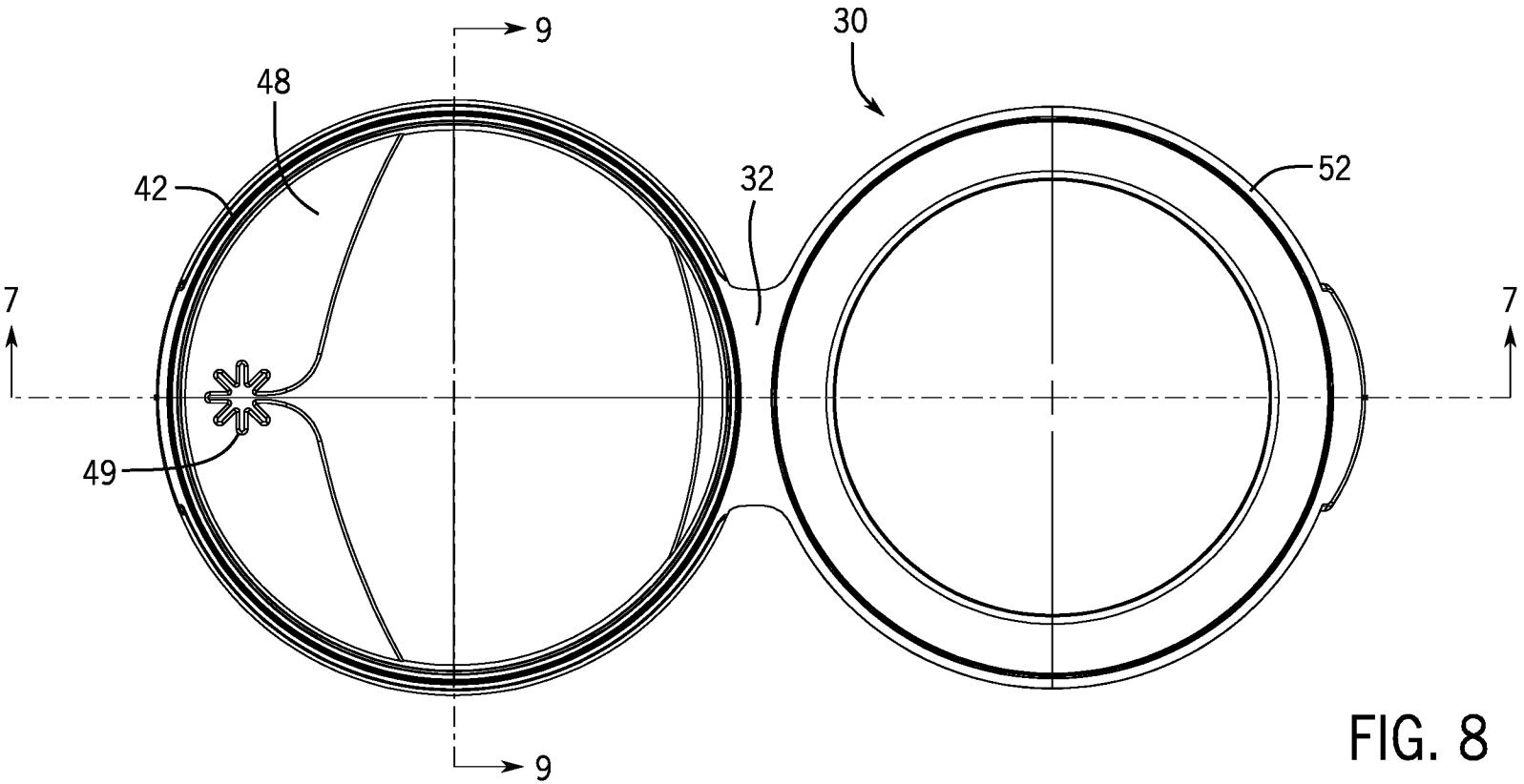
FIG. 8 is a top plan view of the cover and lid also with the lid being shown in the "open" position.
Figure 9:
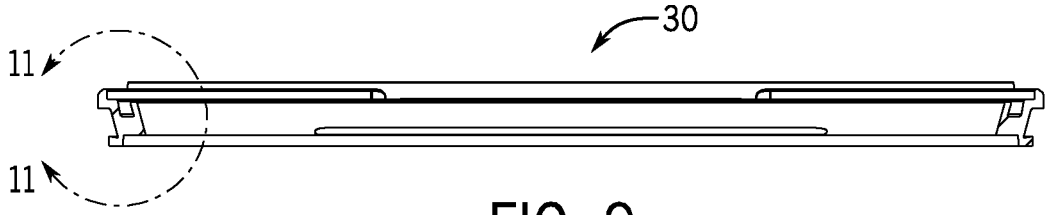
FIG. 9 is an enlarged cross-sectioned view taken along line 9-9 of FIG. 8 but showing the lid in the "closed" position.

FIGS. 7 and 8 show the container cover 30 illustrated in FIG. 2 from a side view and top plan view, respectively. FIG. 7 is illustrative of the low profile that is realized in this particular configuration. As shown, the container cover base 40 comprises an outer peripheral edge 42 and the container cover lid 50 likewise comprises an outer peripheral edge 52. At one part of the container cover 30, the container cover base 40 and the container cover lid 50 are joined together by a hinged structure 32. This hinged structure 32 allows the container cover lid 50 to be folded over to the point that it engages the container cover base 40. That engagement will be discussed further following the detailed description as to the engagement of the container cover 30 with the container 20.

Figure 10:
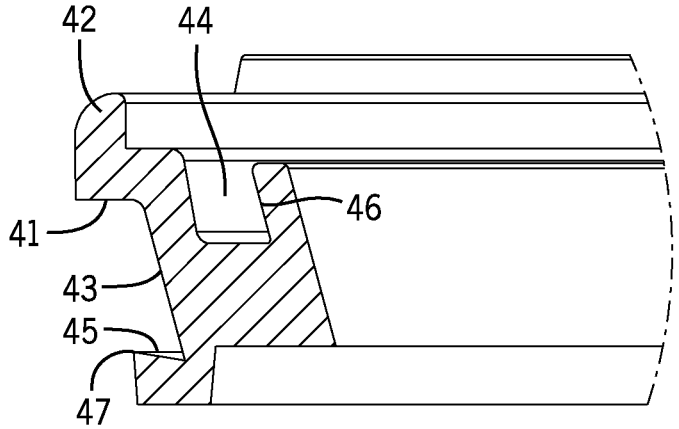
FIG. 10 is a greatly enlarged cross-sectioned profiled view of the cover edge without engagement of the lid with the cover edge.
Figure 11:
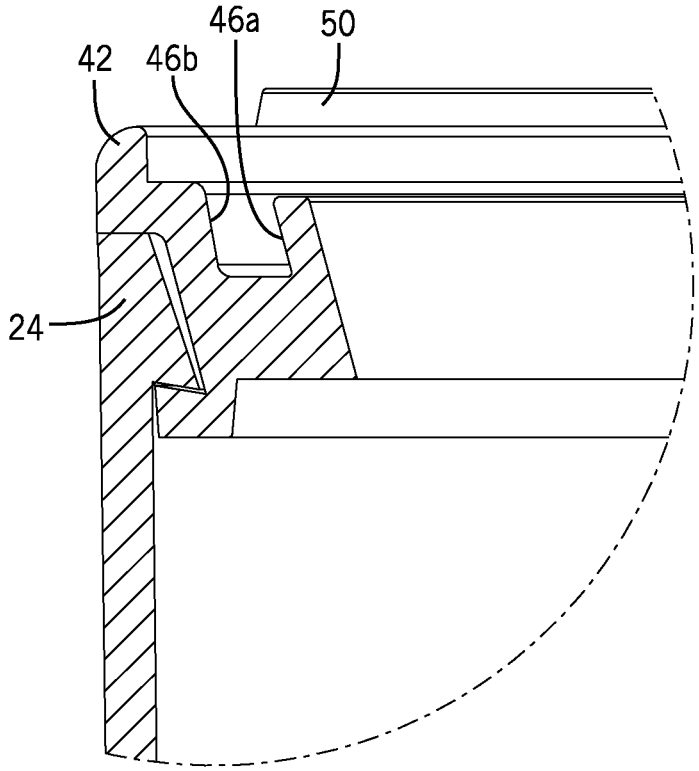
FIG. 11 is another greatly enlarged cross-sectioned view of the cover edge, taken along circular line 11 of FIG. 9, but showing the cover engaged with the upper rim of the container.

Referring now to FIG. 10, it will be seen that the outer peripheral edge 42 of the container cover base 40 further comprises a circumferential outer top ledge 41 and an outer surface 43 that is biased inwardly moving from the top ledge 41 down to a bottom ledge 45. The bottom ledge is an upwardly biased top surface that terminates at a point 47. Collectively, the outer top ledge 41, outer surface 43 and bottom ledge 45 form a circumferentially-extending side gap that is configured to capture the outer perimeter structure of the container 20 as shown in FIG. 11. When captured in this fashion, a tight seal is made between the container 20 and the container cover 30. It is also to be understood that the container cover base 20 also comprises a circumferential top gap 44 that comprises an inner side surface 46*a* and an outer side surface 46*b*, each biased outwardly moving upwardly from the bottom of the gap 44. This gap 44 is provided to allow secure engagement of a complementary structure (not shown) that extends downwardly from the underside of the lid 50 when the lid is in a "closed" position.

The invention claimed is:

1. A low profile container cover assembly comprising:

a container, the container comprising a circumferential bottom edge, a circumferential top edge and a solid container wall extending between the bottom edge and the top edge; the top edge comprising a circumferential inner wall portion that is biased inwardly moving downwardly from the top edge of the container; the inner wall portion terminating at a circumferential catch disposed below the top edge; and a circumferential recess disposed below the top edge and biased upwardly moving outwardly from the circumferential catch; and a container cover subassembly that provides complementary structure for engagement of the container cover with the container cover base, the container cover subassembly comprising:

a container cover base comprising an outer peripheral edge that comprises a circumferential outer surface and a circumferential side gap defined in the circumferential outer surface, wherein the container cover gap comprises:

a circumferential outer top ledge;

a circumferential outer bottom ledge, the bottom ledge is an upwardly biased top surface that terminates at a point; and an outer surface disposed between the outer top and bottom ledges;

wherein the top and bottom ledges are disposed at a slight upward angle relative to the horizontal moving outwardly of the cover; and wherein the outer surface is disposed at a slight upward angle from the vertical moving outwardly of the cover;

a container cover lid; and a flexible hinge connecting the container cover lid to the container cover base.

2. The low profile container cover subassembly of claim 1 wherein, when the cover assembly is attached to the container, the top ledge of the container cover gap is juxtaposed to the top edge of the container, the catch of the container is juxtaposed to the bottom ledge, and the outer surface of the container cover gap is juxtaposed to the inner wall portion of the container.

* * * * *